US008727448B1

(12) United States Patent
Pagano

(10) Patent No.: US 8,727,448 B1
(45) Date of Patent: May 20, 2014

(54) INFANT SUPPORT SEAT CUSHION

(75) Inventor: Paul Pagano, Canfield, OH (US)

(73) Assignee: Pagano Innovations LLC, Canfield, OH (US)

( * ) Notice: Subject to any disclaimer, the term of this patent is extended or adjusted under 35 U.S.C. 154(b) by 113 days.

(21) Appl. No.: 13/486,087

(22) Filed: Jun. 1, 2012

(51) Int. Cl.
*A47C 31/00* (2006.01)

(52) U.S. Cl.
USPC ..... 297/464; 297/250.1

(58) Field of Classification Search
USPC ..... 297/174 R, DIG. 1, 467, 15, 452.15, 297/452.17, 250.1, 256.15
See application file for complete search history.

(56) References Cited

U.S. PATENT DOCUMENTS

| | | | | | |
|---|---|---|---|---|---|
| 1,776,122 | A | * | 9/1930 | Krasnick | 297/467 |
| 3,558,186 | A | * | 1/1971 | Shore et al. | 297/136 |
| 3,620,570 | A | * | 11/1971 | Wilson et al. | 297/451.12 |
| 4,143,915 | A | * | 3/1979 | Kamlay | 297/488 |
| 4,441,221 | A | * | 4/1984 | Enste et al. | 297/464 |
| 4,750,478 | A | * | 6/1988 | Bergeron | 128/870 |
| 4,912,788 | A | * | 4/1990 | Lonardo | 297/452.26 |
| 5,005,526 | A | * | 4/1991 | Parker | 297/256 |
| 5,076,264 | A | * | 12/1991 | Lonardo et al. | 297/464 |
| 5,163,737 | A | * | 11/1992 | Navach et al. | 297/DIG. 1 |
| 5,183,311 | A | | 2/1993 | Meeker et al. | |
| D355,306 | S | * | 2/1995 | Moses | D6/333 |
| 5,519,906 | A | | 5/1996 | Fanto-Chan | |
| 5,661,861 | A | | 9/1997 | Matthews | |
| 5,732,999 | A | * | 3/1998 | Petrie | 297/136 |
| 5,779,306 | A | * | 7/1998 | Ohlsson | 297/256.16 |
| 6,000,761 | A | * | 12/1999 | Rocha | 297/464 |
| 6,033,019 | A | * | 3/2000 | Hession-Kunz et al. | 297/250.1 |
| D450,516 | S | | 11/2001 | Darling et al. | |
| D450,517 | S | | 11/2001 | Darling et al. | |
| 6,532,595 | B1 | * | 3/2003 | Holmes | 2/48 |
| 6,626,487 | B1 | | 9/2003 | Buitendach | |
| 6,685,024 | B1 | | 2/2004 | Matthews | |
| 6,810,545 | B1 | | 11/2004 | Darling et al. | |
| 6,905,169 | B1 | * | 6/2005 | Donoghue | 297/250.1 |
| 7,287,816 | B1 | * | 10/2007 | Karl | 297/452.17 |
| 7,356,861 | B1 | * | 4/2008 | Pagano | 297/464 |
| 7,585,021 | B2 | * | 9/2009 | Tabata | 297/188.14 |
| 7,886,694 | B2 | * | 2/2011 | Jakubowski et al. | 119/28.5 |
| 8,267,473 | B2 | * | 9/2012 | Flannery et al. | 297/256.16 |
| D687,638 | S | * | 8/2013 | Beda et al. | D6/333 |
| 2004/0084938 | A1 | * | 5/2004 | Tomas et al. | 297/250.1 |
| 2005/0200169 | A1 | * | 9/2005 | Tipton | 297/188.01 |
| 2009/0031490 | A1 | * | 2/2009 | Kassai et al. | 4/572.1 |

* cited by examiner

*Primary Examiner* — Jose V Chen
(74) *Attorney, Agent, or Firm* — Harpman & Harpman

(57) ABSTRACT

An infant support and stabilization cushion seat to provide a safe and secure containment and retainment of an infant in a sitting position. The support cushion seat is formed of a resilient shape retaining foam core with a yielding encapsulating surface cover material defining a contoured child receiving area therewithin. An integrated access retainment tray portion overlies a portion of the child receiving area and is deflectable for child placement and retrieval returning to the original orientation, once released.

14 Claims, 4 Drawing Sheets

INFANT SUPPORT SEAT CUSHION

BACKGROUND OF THE INVENTION

1. Technical Field

This device relates to an infant and child support and stabilization containment cushion that securely confines and supports a child in a desired position.

2. Description of Prior Art

Prior art devices of this type have been directed towards cushion configurations oriented to hold or support an infant, caregiver or adults in engaging manner, see for example U.S. Pat. Nos. 5,183,311, 5,519,906, 5,661,861, 6,626,487, 6,685,024, 6,810,545, and Design Pat. D450,517 and D450,516.

In U.S. Pat. No. 5,183,311 discloses a portable highchair/booster seat having parallel spaced arms on which a detachable tray is secured.

In U.S. Pat. No. 5,661,861 a support pillow is illustrated that is positioned about the upper torso of a user so that the arms can rest thereon in a sitting position.

U.S. Pat. No. 6,626,487 illustrates a baby chair having a contoured integrated one-piece seat, backrest and side supports with tray mounting openings therewithin. A front support defines spaced front openings for the legs with an upright frontal support structure therebetween.

U.S. Pat. No. 6,685,024 shows a support pillow and method of use in which a horseshoe shaped pillow is configured defining a circular opening well within.

U.S. Pat. No. 6,810,545 is directed towards an infant support pillow and method of assembly in which a pillow body has two contoured arms extending from a media region in spaced parallel relation in a U-shaped form.

Design Pat. D450,519 is directed to an infant support pillow having a general horseshoe configuration and Design Pat. D540,516 is an ornamental design wherein an infant support pillow is described in U.S. Patent above ending in 545.

Finally, applicant's own U.S. Pat. No. 7,356,861 discloses an infant support seat cushion having multiple pairs of oppositely disposed depending sidewalls with an opening formed in the front wall defined by a pair of abutting arm portions hooked together with fasteners.

SUMMARY OF THE INVENTION

An infant support and entertainment cushion chair in which a soft resilient contoured body member is defined with an infant receiving opening centrally located therewithin. The support cushion chair rests on the floor having a wide stable base with the infant positioned therewithin in a seating position. The seat access portion is defined by a flexible integral tray restraint extending over and defining a leg receiving opening between the arm support surrounding portions with upper surfaces and activity recess openings therewithin. Auxiliary strap retaining and positioning slots and receiving recess define safety strap alignment for an infant, if used.

DETAILED DESCRIPTION OF THE INVENTION

Figure 1:
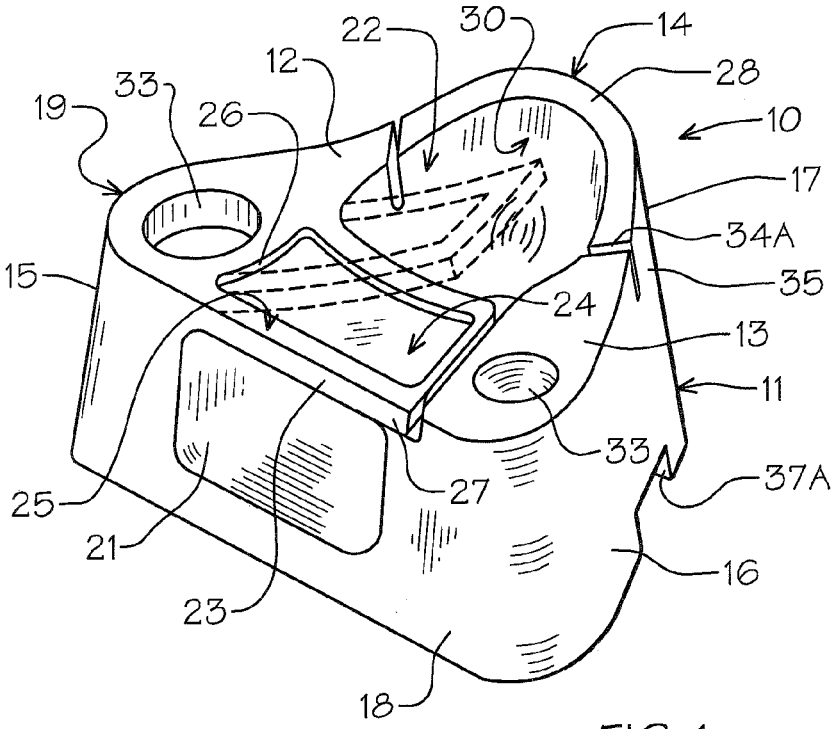
FIG. 1 is a perspective view of the infant support cushion chair.
Figure 2:
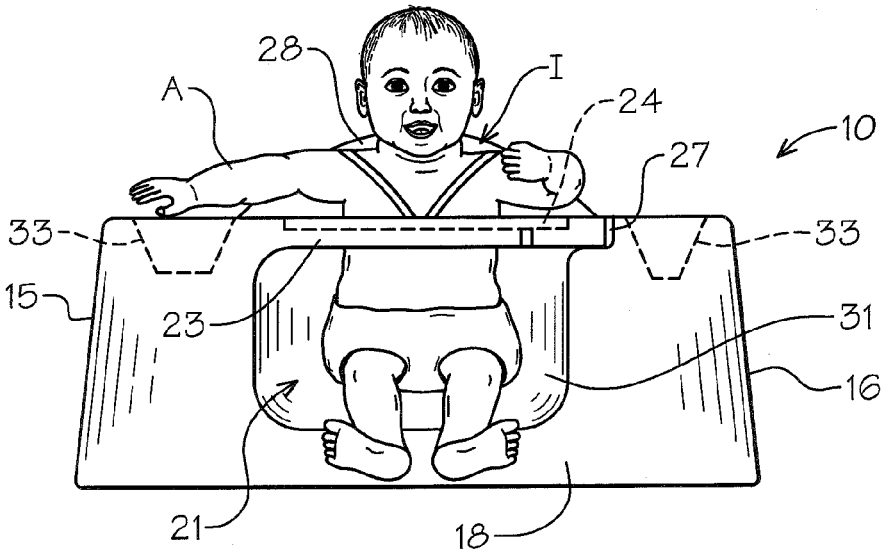
FIG. 2 is a front elevational view thereof showing an infant positioned therewithin.
Figure 3:
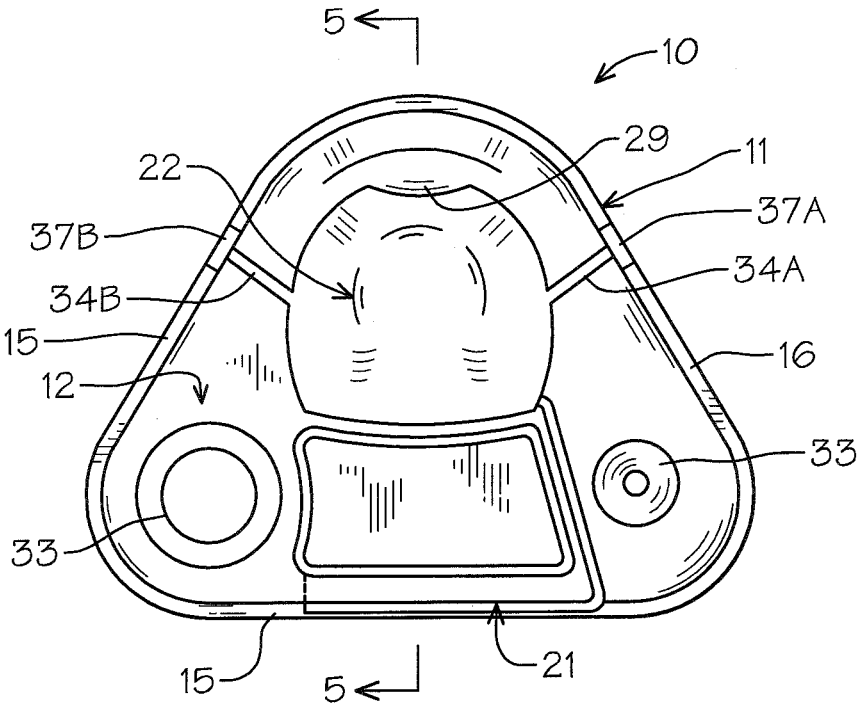
FIG. 3 is a top plan view of the infant cushion support chair.

Referring to FIGS. 1-5 of the drawings, an infant support cushion seat 10 of the invention can be seen having a main monolithic resilient foam core body member 11 of a generally triangular configuration with upper flat arm surfaces 12 and 13, an upstanding contoured back portion 14 and oppositely disposed inclined depending sidewalls 15 and 16. Interconnecting inclined back sidewall 17 and oppositely disposed inclined front sidewall 18. Arm portions 19 and 20 are defined by the arm surfaces 12 and 13 and respectively depending sidewalls 15 and 16. The front depending sidewall 18 has a rectangular access opening 21 within extending to and in communication with a central circular contoured opening at 22 within the main body member 11 between respective arm portions 19 and 20 and respective depending sidewalls 15 and 16.

A tray portion 23 extends integrally from the arm portion 19 to the arm portion 20 over the leg access opening 21 within the front sidewall 18 as best seen in FIG. 1 of the drawings.

The tray portion 23 has a recessed area 24 in its top surface 25 defined by a contoured rectangular wall edge surface 26 thereabout. The free end of the tray portion at 27 rests on a support ledge 28 formed in the opposing arm portion 20 along the hereinbefore defined leg access opening 21 within the front wall 18. Given the tray portion 23 reduced dimensional thickness, it can be deflected integrally as a unit from its "at rest" horizontal orientation upwardly as seen in broken lines in FIG. 1 of the drawings and in solid lines in an alternate form of the invention illustrated in FIG. 8 as will be described in greater detail hereinafter.

The flexibility and material memory of the tray portion 23 is due to the construction design and materials of choice in which, as noted, the body member is formed of a resilient synthetic resin foam core of a shape retaining density sufficient to provide yielding support to the infant placed within the central opening 22 of the cushion chair seat of the invention. A synthetic foam core is preferably encapsulated in a flexible synthetic covering for ease of maintenance and cleaning as will be evident to those skilled within the art.

Figure 5:
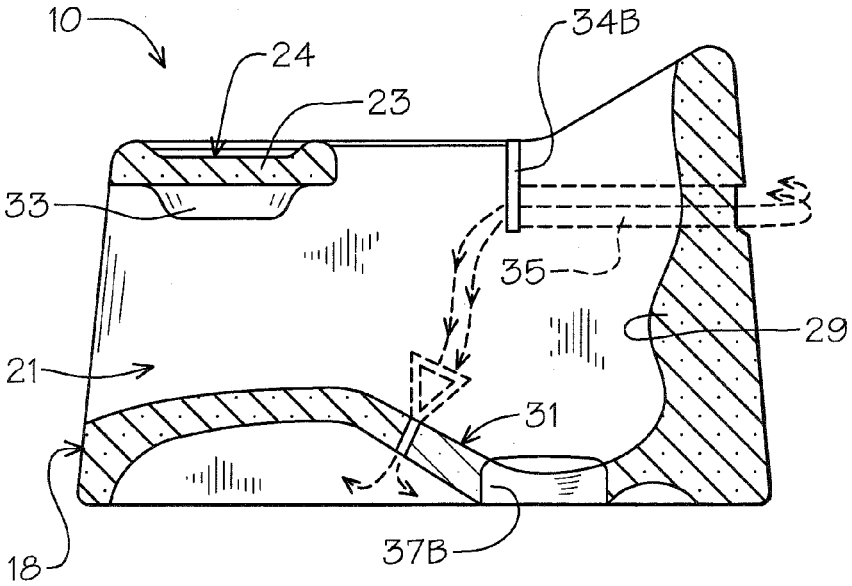
FIG. 5 is a sectional view on lines 5-5 of FIG. 3.
Figure 6:
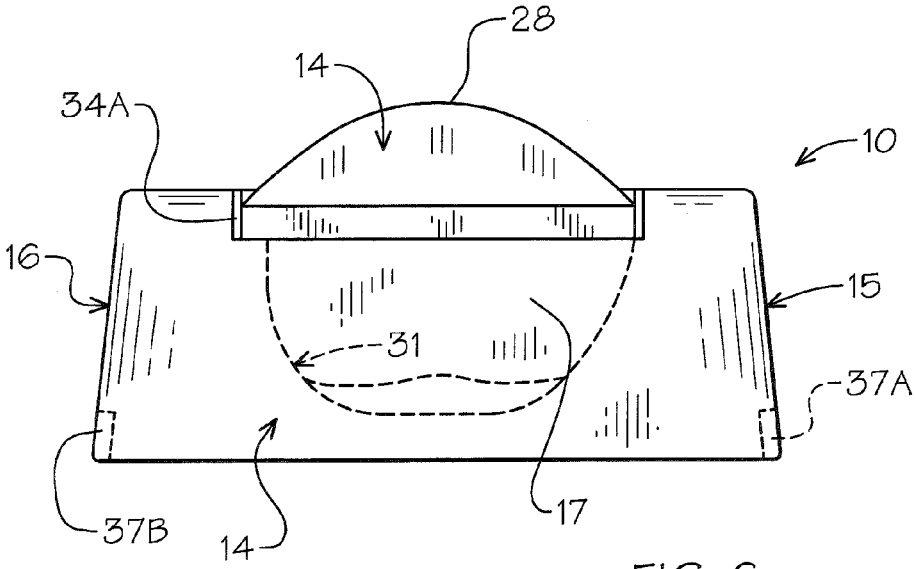
FIG. 6 is a rear elevational view thereof.

Referring now to FIGS. 1, 2, 5 and 6 of the drawings, an elevated back rest portion 28 is defined by the back sidewall 17 so as to provide support to an infant I and has a contoured back support protrusion 29 on its lower inner surface 30 which when combined with a recessed contoured seat bottom 31, best seen in FIG. 5 of the drawings will provide a superior stabilized seating position for the infant I. The front wall opening 21 is in spaced relation to the ground engagement surface of the body member 11 affording therefore an elevated contoured infant leg support surface 32.

Each of the arm portions 21 and 22 have respective annular receptacles 33 extending within their upper arm surfaces 12 and 13 to provide for use by the infant placement and positioning of items therewithin for ease of access and use.

It will be evident from the above description that the infant's arms A will be well above the upper surface 12 and 13 of the arms 21 and 22 and the tray portion 23 allowing for free use thereof as described.

A pair of respective angular guide slots 34A and 34B are formed in a transition area defined between the arm portions 21 and 22 and contoured back support area and have an interconnecting shallow strap guide channel 35 extending horizontally therebetween on the outside back surface to receive an optional infant retaining strap assembly 36 illustrated in broken lines which may be required in a user determined situation, as seen in FIG. 5.

Typically, the inner seat engagement contours generally indicated at SC, best seen in FIG. 5 of the drawings may be sufficient to support and contain the infant therewithin without the additional strap restraints, as noted above.

Figure 4:
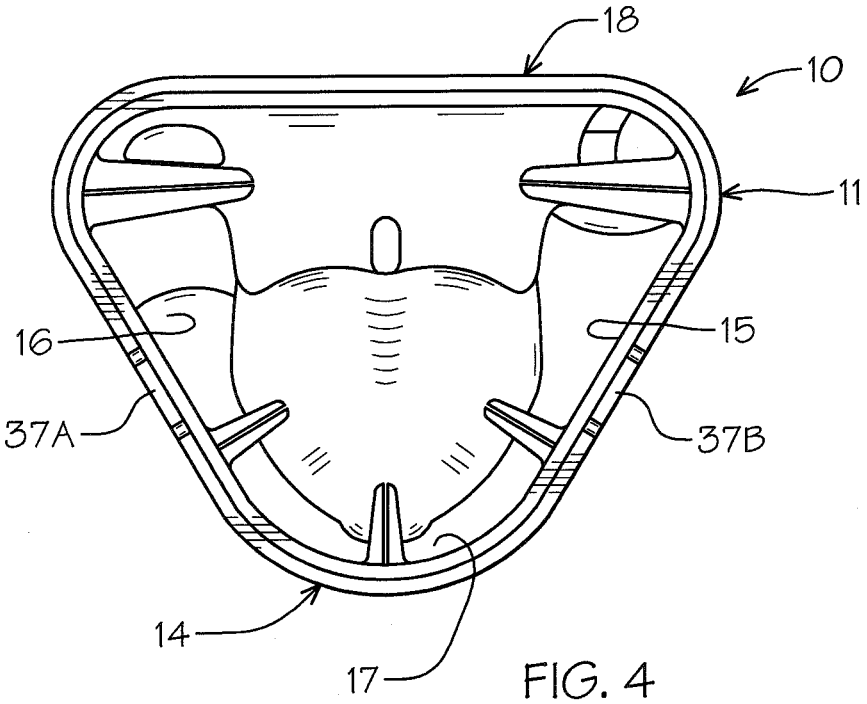
FIG. 4 is a bottom plan view thereof.

A pair of oppositely disposed handgrip engagement openings 37A and 37B are formed within the respective inclined sidewalls extending upwardly from the ground engagement base defined surface to afford a user the ease of movement and transport as best seen in FIGS. 1, 4 and 5 of the drawings.

It will be evident that the dimensions of the infant support cushion chair seat 10 are such as to provide adjustable engagement with the infant I within a certain early age group associated with primary motor skill development such as sitting. The cushion configuration of the invention will also serve as a comfortable confinement placement device assuring a safe and stable entertainment upright environment for the infant and affording a hands off orientation action for the parents or caregiver, not shown. The dimensional aspects of the infant cushion of the invention 10 is defined by the height of the main body member arm portions 20 and 21 being such that the infant's arms A will always be above the arm portion surfaces 12 and 13 allowing for easy access to the hereinbefore described item receiving recesses therewithin.

Figure 7:
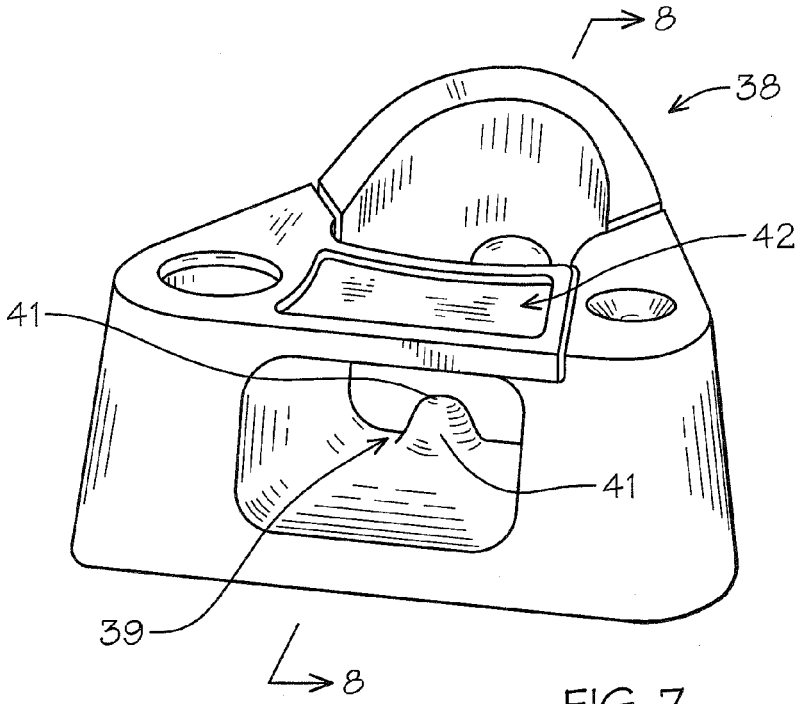
FIG. 7 is a perspective view of an alternate form of the infant support cushion chair.
Figure 8:
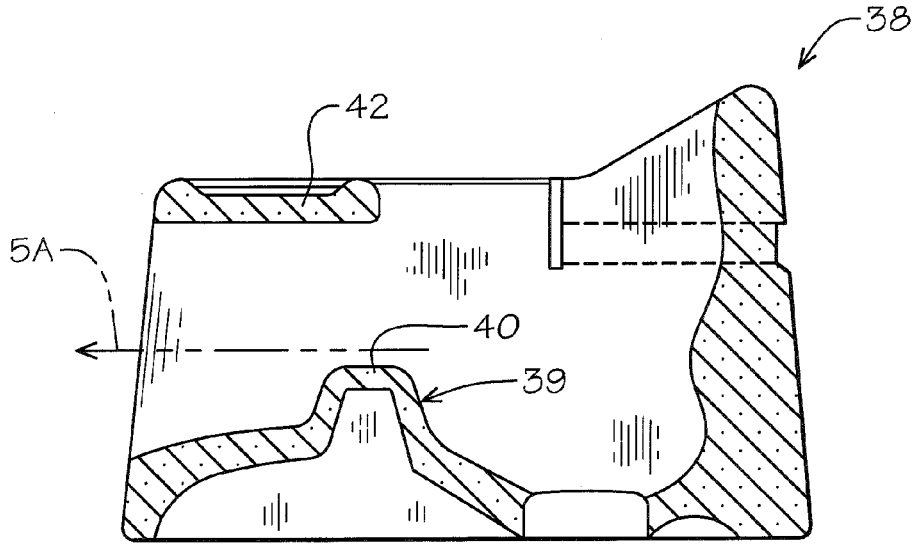
FIG. 8 is a sectional view on lines 8-8 of FIG. 7.

Referring now to FIGS. 7 and 8 of the drawings, an alternate form of the invention 38 can be seen having essentially all of the primary elements of the hereinbefore described primary form of the invention 10 with the added element of a contoured upstanding support knob 39 extending from the base of the seat portion's elevated leg support within the front wall opening 18. The support knob 39 is centered within the seat defined interior surface with a rounded top portion 40, contoured depending tapered annular side 41 as best seen, as noted, in FIG. 7 of the drawings.

The support knob 39 so positioned provides additional infant restraint by preventing the infant I from sliding outwardly leg first as indicated by slide indication broken arrows SA in FIGS. 7 and 8 of the drawings.

The alternate form as hereinbefore described will also have a bendable tray 42 which can be deflected or bent upwardly allowing ease of access in placing and removing the infant I (not shown) from therewithin.

Should the infant strap retainment assembly 36 be required, strap elements indicated by directional arrows SE would extend through the respective strap guide slots 34A and 34B around the back wall within the guide channel 35. A crotch engagement plate 43 having a pair of straps S extending from with a central opening 44 all indicated in broken lines would be provided so as to loop out over the infant and then across and through the hereinbefore described guide slots in either form of the invention hereinbefore described.

It will be evident that such a strap configuration would have registration clips 44 so as to provide adjustable confinement of the infant dependent on infant size and placement therewithin.

It will thus be seen that a new and novel infant support seat cushion chair has been illustrated and described and it will be apparent to those skilled in the art that various changes and modifications may be made therein without departing from the spirit of the invention. Therefore I claim:

I claim:

1. A support device for an infant in a sitting position comprises, a contoured shaped cushion configuration having a top surface with interconnected depending sides, front and rear back wall surfaces, a central infant receiving opening within said top surface, a pair of arm rest portions formed within the cushion in spaced angularly disposed relation to one another, a flexible infant containment and utility tray portion extending integrally from one of said arm rest portions and selectively engaged on said oppositely disposed arm rest portion overlying a central infant leg opening in said front wall surface between said arms rest portions, said utility tray portion movable from a first horizontal arm rest portion engagement position to a second infant access and removal position in spaced relation to said other arm rest portion.

2. The support device for an infant set forth in claim 1 wherein said central infant receiving opening has an integral upstanding curved back rest portion with a contoured protrusion extending therefrom.

3. The support device for an infant set forth in claim 1 wherein said arm rest portions have recess placement areas on their respective top surfaces for receiving selective items therewithin.

4. The support device for an infant set forth in claim 1 wherein said infant leg opening in said front wall surface has a contoured elevated infant leg engagement support surfaces.

5. The support device for an infant set forth in claim 1 wherein said flexible infant containment and utility tray portion has a contoured recess area within its top surface.

6. The support device for an infant set forth in claim 1 wherein said arm portions have infant containment strap harness angularly disposed guide slots therewithin, a recessed guide channel in said rear back wall surface between said angularly disposed guide slot openings.

7. The support device for an infant set forth in claim 1 wherein said depending sidewall surfaces have hand engagement opening therewithin.

8. The support device for an infant set forth in claim 1 wherein said cushion configuration comprises a resilient foam core with a yieldable encapsulating cover thereabout.

9. A support device for an infant in a sitting position comprises, a generally triangular shaped cushion configuration having a top surface, interconnected depending sides, front and rear back wall surfaces, a central infant receiving opening within said front wall top surface, a pair of arm rest portions formed within the cushion in spaced angularly disposed relation to one another, a flexible infant containment and utility tray portion extending integrally from one of said arm rest portions to said remaining arm rest portion overlying a central infant leg opening in said front wall surface, said utility tray portion resiliently movable from a first horizontal arm rest engagement position to a second infant access and removal position in spaced relation to one of said remaining arm rest portion, an upstanding contoured infant engagement support knob extending from a contoured elevated infant leg engagement support surface defining parallel spaced leg passages therebetween.

10. The support device for an infant set forth in claim 9 wherein said central infant leg opening has an upstanding curved back rest portion with a contoured protrusion extending therefrom.

11. The support device for an infant set forth in claim 9 wherein said arm rest portions have secure recess placement areas on the respective top surfaces for receiving selective items therewithin.

12. The support device for an infant set forth in claim 9 wherein said flexible infant containment and utility tray portion has a contoured recess area within its top surface.

13. The support device for an infant set forth in claim 9 wherein said arm rest portions have infant containment strap harness guide slots therewithin, a recessed guide channel in said back wall surface between said guide slot openings in angularly disposed relation to one another.

14. The support device for an infant set forth in claim 9 wherein said depending sides have hand engagement opening therewithin.

* * * * *